US005802806A

United States Patent [19]

Scaliti

[11] Patent Number: 5,802,806

[45] Date of Patent: Sep. 8, 1998

[54] MACHINE FOR WRAPPING WITH SHEET MATERIAL

[75] Inventor: Pier Carlo Scaliti, Rodello, Italy

[73] Assignee: Soremartec S.A., Belgium

[21] Appl. No.: 841,949

[22] Filed: Apr. 8, 1997

[30] Foreign Application Priority Data

Apr. 15, 1996 [CH] Switzerland ..... 0952/96

[51] Int. Cl.[6] ..... B65B 11/54

[52] U.S. Cl. ..... 53/226; 53/221

[58] Field of Search ..... 53/226, 464, 461, 53/220, 227, 221

[56] References Cited

U.S. PATENT DOCUMENTS

| | | | |
|---|---|---|---|
| 2,009,241 | 7/1935 | Roberts | 53/226 |
| 2,624,993 | 1/1953 | Robertson | 53/226 |
| 2,830,417 | 4/1958 | Ullman et al. | 53/226 |
| 2,838,897 | 6/1958 | Ponten et al. | 53/226 |
| 3,106,050 | 10/1963 | Westphal et al. | 53/226 |
| 4,510,735 | 4/1985 | Cillario | 53/464 |

FOREIGN PATENT DOCUMENTS

| | | |
|---|---|---|
| 0082952 | 7/1983 | European Pat. Off. . |
| 0110080 | 6/1984 | European Pat. Off. . |

*Primary Examiner*—James F. Coan
*Attorney, Agent, or Firm*—Rothwell, Figg, Ernst & Kurz, P.C.

[57] ABSTRACT

The articles to be wrapped are located over the mouth of a forming device with the interposition of a sheet of wrapping material. Extending from this mouth is a cavity in which, as a result of the advancement of the article caused by a pusher element, the wrapper material is wrapped around the front face of the article relative to its direction of the advance. Subsequently the cavity contracts around behind the article to be wrapped and this contraction completes the wrapping of the wrapper material around the article itself. The preferred application is in the packaging of food products such as, for example, confectionery products.

20 Claims, 7 Drawing Sheets

MACHINE FOR WRAPPING WITH SHEET MATERIAL

The present invention relates to a machine for wrapping with sheet material according to the introduction to claim 1.

A machine of this type is known, for example, from U.S. Pat. No. 4,510,735.

A machine which fulfils substantially the same purpose but makes use of a different technical solution is known however from EP-A-0 110 080.

The object of the present invention, having the further features set forth in the characterising portion of claim 1, is to provide a further improvement in the solution of U.S. Pat. No. 4,510,735 particularly with regard to the possibility of ameliorating the forces applied to the wrapped object during the formation of the wrapper around the object and during the final step in which the wrapper in question is closed around the object, which latter phase is sometimes called "combing".

Figure 13:
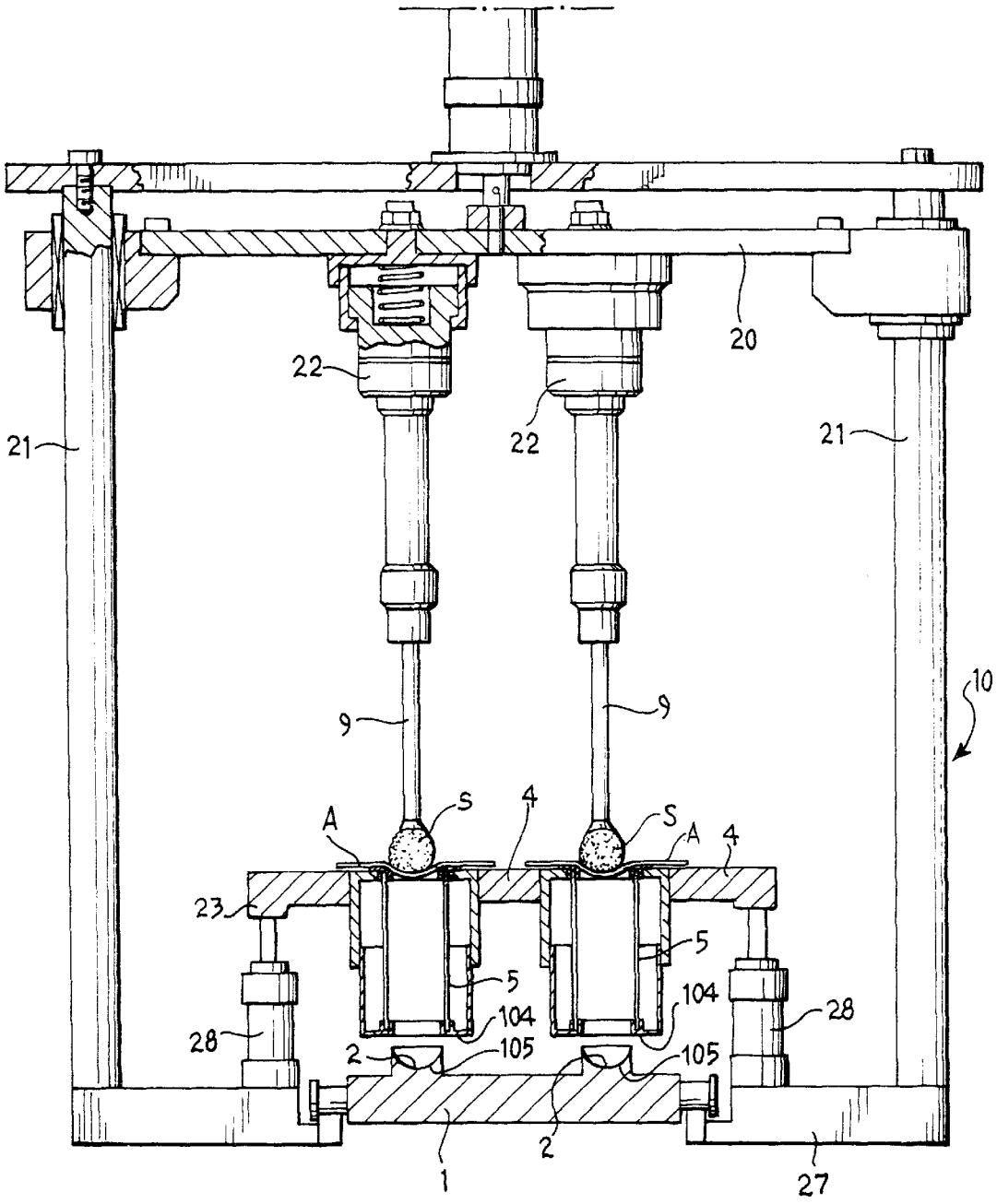
Figure 14:
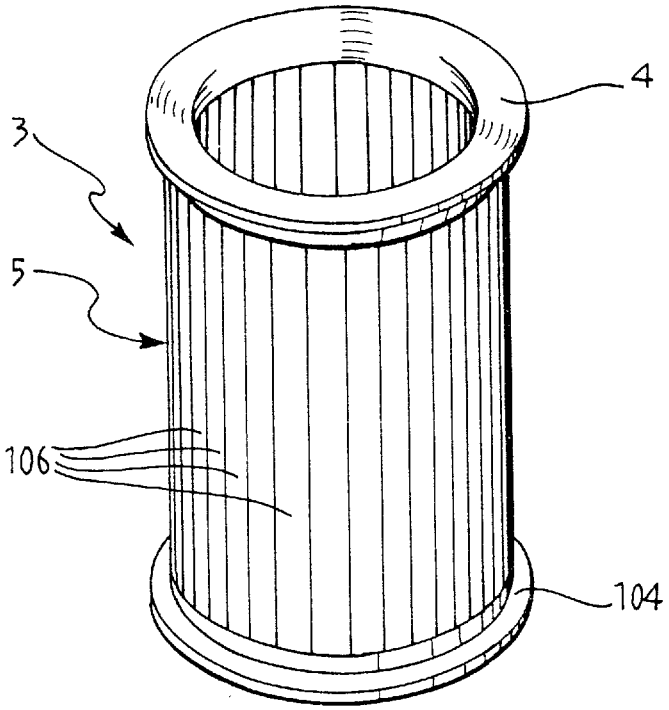
Figure 15:
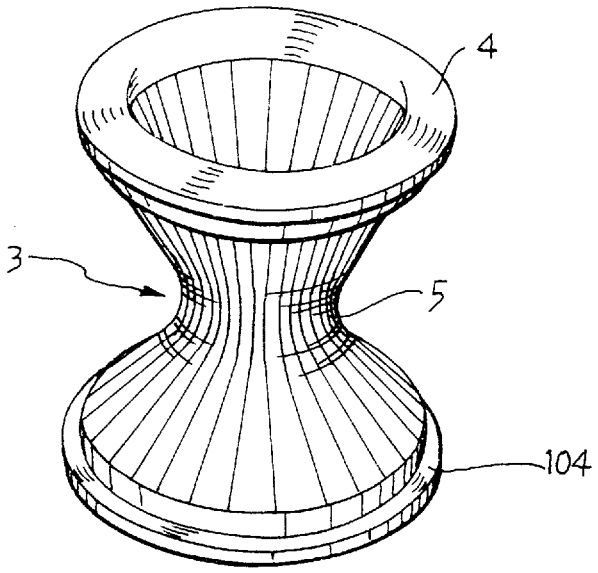
Figure 16:
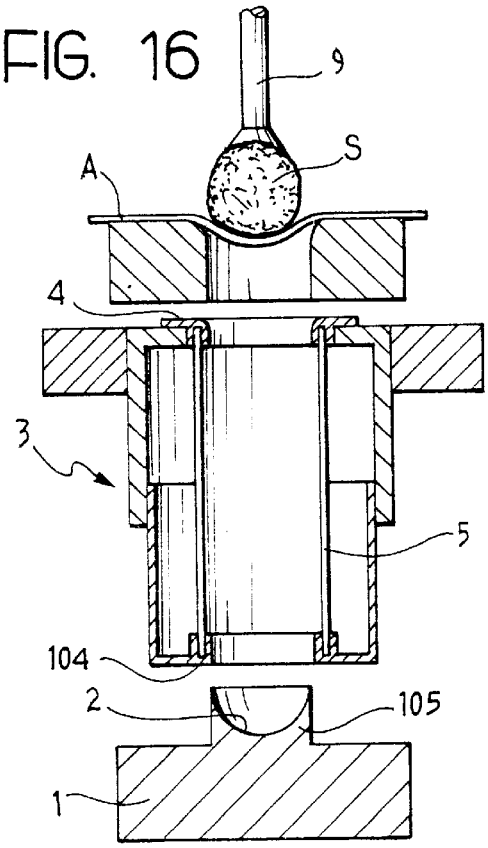

The invention will now be described, purely by way of non-limitative example, with reference to the appended drawings, in which:

FIGS. 1 to 4 illustrate schematically the operation of the machine of U.S. Pat. No. 4,510,735 with the primary intention of identifying the problems solved by the present invention, FIGS. 5 to 8 show schematically, in a manner substantially like those of FIGS. 1 to 4, the operation of a first embodiment of a machine according to the invention, FIGS. 9 to 12 illustrate, again according to the same criteria, the operation of a second embodiment of the machine according to the invention, FIG. 13 is a general view of the structure of a third possible embodiment of a machine according to the invention which is currently preferred, FIGS. 14 and 15 illustrate, in greater detail, the characteristics of an element illustrated in FIG. 13 in two different possible operating conditions, and FIGS. 16 to 20 return to a convention substantially like that adopted in FIGS. 1 to 12 to illustrate the operation of the third embodiment of the machine of the invention.

FIGS. 1 to 4 show generally indicated S a spherical article having small projections distributed over its surface. In one possible embodiment of the invention, the article S is a sweet product such as the praline sold under the mark "Rocher" by the companies of the Ferrero group. One is dealing with a praline constituted by a spherical wafer shell containing a paste like or creamy filling with a chocolate flavour, coated on the outside with hazelnut chips and chocolate. One is thus dealing with a rather delicate article which should not be subjected to too vigorous handling.

The reference to the "Rocher" praline should however be understood as being purely an example since the invention enables sheet wrappers to be formed for any type of article, not even necessarily food articles.

Reference A indicates a thin sheet of aluminium intended to be wrapped around the article S as the wrapper.

Reference 1 indicates a receiving element including a cavity 2 having a shape complementary to the lower part of the product S, and thus of hemispherical shape in the embodiment illustrated. In this respect it should be specified that the invention is not in any way limited to use with spherical articles.

Continuing still with a description of FIGS. 1 to 4, which correspond to the homologous figures of U.S Pat. No. 4,510,735, these show a forming device 3 aligned vertically above the receiving element 1 and constituted by a ring 4 located coaxially of the hemispherical cavity 2. A plurality of resilient blades or leaves 5 (typically of metal) project downwardly from the ring 4 with their free ends 6 converging in a configuration which can be likened to the leaves of an artichoke.

A piston 7 provided in its lower end with a hemispherical cavity 8 (or, generally, a cavity having a configuration complementary to that of the upper part of the article S) is located on the common axis of vertical alignment of the receiving cavity 2 and the unit comprising the ring 4/blades 5. A pusher rod 9 intended to act on the article S passes through the centre of the piston 7.

In use (for a more detailed explanation refer to the description of U.S. Pat. No. 4,510,735), the sheet A of the material constituting the wrapper (typically aluminium foil) is located above the central orifice of the annular member 4 and the article S 1s deposited (by known means, not illustrated) on the sheet A itself in correspondence with the central orifice. Here the sheet A has preferably been preformed (by known means) into a generally hollow shape so as to be able to receive and retain the article S more securely, without risk of displacement.

Figure 1:
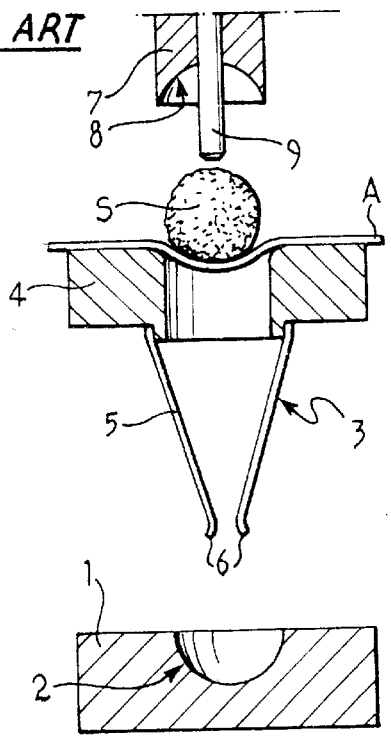
FIG. 1 PRIOR ART
Figure 2:
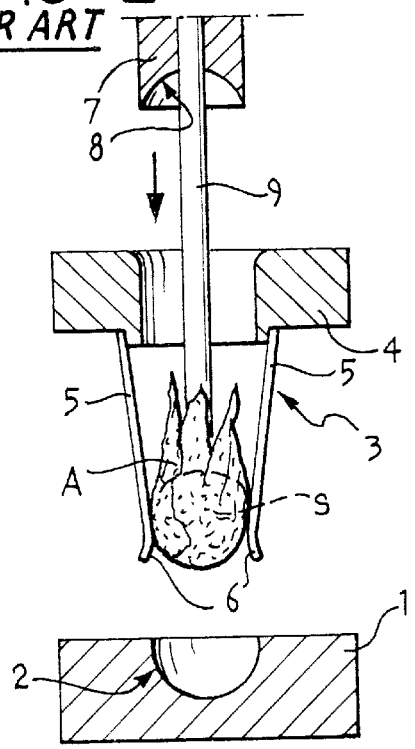
FIG. 2 PRIOR ART
Figure 3:
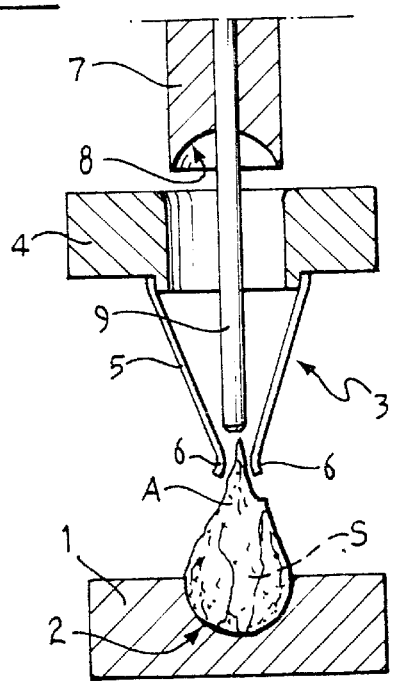
FIG. 3 PRIOR ART
Figure 4:
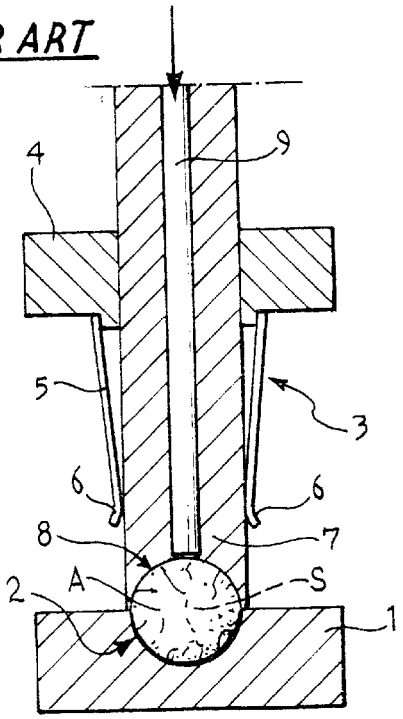
FIG. 4 PRIOR ART
Figure 5:
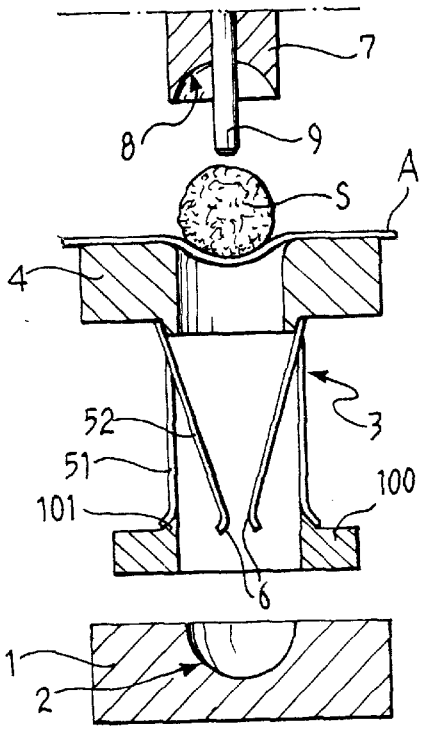
Figure 6:
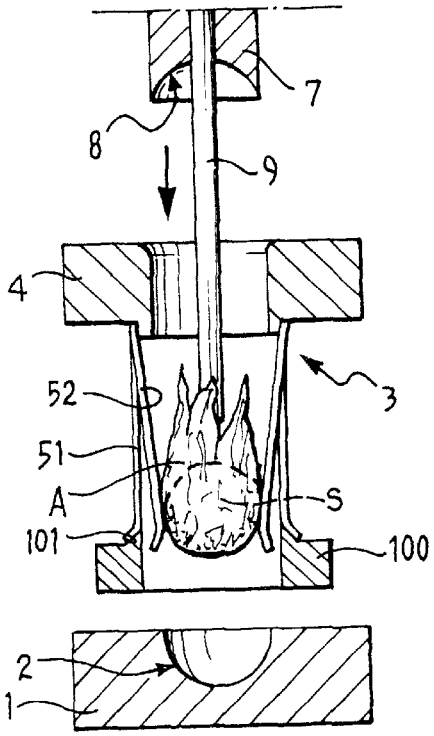
Figure 7:
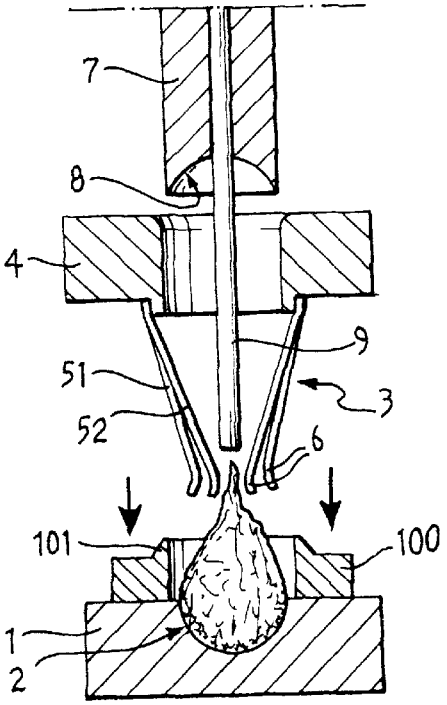

Once the said position has been reached (which is substantially that illustrated in FIG. 1) the pusher element 9 is lowered so as to force the article S downwardly through the axial orifice in the ring 4 and into the cavity defined by the blades 5, as shown schematically in FIG. 2.

The article S draws the sheet A with it in this advancing movement. As a result of the forcing between the blades 5, which diverge resiliently, the sheet material A starts to be wrapped around the lower surface (that is the front surface relative to the direction of advance) of the article S so that its marginal portions form a sort of tail or bunch above the article itself.

As the article S wish the sheet A wrapped around it continues to move downwardly towards the cavity 2 under the action of the pusher element 9, it passes beyond the free ends 6 of the blades 5. These latter return resiliently into their closed positions and, as a result of their converging movements, close the tail or bunched portion over the article S (and hence on the rear surface relative to the direction of advance). The whole occurs in the manner shown schematically in FIG. 3.

The further descent of the piston 7 (FIG. 4) causes the blades 5 to open apart again. This is caused by the downward movement of the head of the piston 7, which is lowermost, until it abuts the article S so as to upset the bunched portion of the wrapper over the outer surface of the article S as a result of the moulding action effected by the cavity 8 in the lower end of the piston 7.

The solution shown schematically in FIGS. 1 to 4 has been used industrially for many years.

Experience of this method in use has shown that, at least in some specific conditions, it is critical to meter the resilient force exerted by the blades 5 exactly if an effective closing or "combing" action on the tail or bunched portion is to be achieved so as to mould this over article S (FIG. 3) while at the same time avoiding the application of too vigorous a force to the article S itself when this descends between the blades 5 so as to force them apart (FIG. 2).

In addition, machines such as that shown in FIGS. 1 to 4 are also affected by the continuing tendency, felt even in the food industry, to operate at ever higher speeds and throughputs. For various reasons (reduction of wear, power usage, etc) this makes it desirable to simplify the structure of the equipment, particularly with regard to reducing the number of parts and, in particular, of those parts which move.

FIGS. 5 to 8 illustrate a first possible solution adopted, in accordance with the invention, to resolve the problems explained above.

As may readily be seen, the steps illustrated in FIGS. 5 to 8 correspond to the steps illustrated in FIGS. 1 to 4 respectively. Hence parts which are identical or functionally equivalent to those already described with reference to FIGS. 1 to 4 have been indicated by the same letters and reference numbers. Similarly, the sequence of operations illustrated in FIGS. 5 to 8 is substantially the same as that of FIGS. 1 to 4 and does not require to be described again.

The solution illustrated in FIGS. 5 to 8 provides for a sort of "division" of the blades in the artichoke structure. The blades in question, of which there may be the same number as those in the conventional solution of FIGS. 1 to 4 (for example eight steel blades), are divided into first and second groups, indicated 51 and 52 respectively, which may, for example, include four blades each. In each group one is concerned, for example, with four blades arranged equiangularly (hence at angular spacings of 90°) with the blades of the two groups arranged so that each blade is between two blades of the other group which are angularly offset by ±45°. This, however, is only one of the many possible solutions.

At the start of the wrapping operation (condition illustrated in FIG. 5 and in effect corresponding to the situation illustrated in FIG. 1) this "division" is such that only one group of blades, in the example illustrated the blades 52, is in the rest condition in which the ends, again indicated 6, of the respective blades converge towards an imaginary axial cavity in the artichoke structure.

The other group of blades, here indicated 51, is instead held in an open position against the intrinsic resilient loading of the blades, by a stop ring 100 which has a rib 101 projecting upwardly and able to engage the ends 6 of the blades 51. These are thus held apart by the ring 100, the rib 101 of which engages them (it is not necessary for this rib to be continuous since it could, for example, be constituted by a ring of teeth or tile-shaped elements which are distinct from each other).

This operating condition is maintained even when the article S is forced downwardly into the artichoke structure 4, 5 as a result of the thrust exerted by the pusher element 9.

In these conditions, only the blades of the first group, that is the blades 52, cooperate with the article S to wrap it in the sheet material A and form the tail or bunch behind (above, in the orientation illustrated here) the article S itself.

When the pusher element 9, in descending, has forced the article S beyond (in the present case below) the imaginary plane identified by the free ends 6 of the blades 51, 52, the ring 100 is lowered by drive means explained in greater detail in relation to the third embodiment of the invention made with reference to FIGS. 13 to 19. The ring 100 disengages the lower ends 6 of the blades 51 which may also close resiliently into the artichoke conformation so as to cooperate with the blades 52 in closing the tail or bunch behind the article S.

During the step in which the wrapper is formed around the product S (FIG. 6), this is thus treated, so to speak, more delicately than in the conventional solution (FIG. 2). Only some of the blades of the artichoke structure, specifically only the blades of the group 52, in fact act to wrap the sheet A around the article S.

All of the blades, that is to say both groups 51 and 52, however, operate to close the tail or bunch structure firmly.

The opening of the blades 51, 52, as a result of the descent of the piston 7 (FIG. 8, reproducing essentially—with regard to the completion of the sheet wrapper around the article S—the mode of operation described above with reference to FIG. 4) may be used to rearm the device by returning the blades 51 to their open positions resulting from the engagement of their free ends with the rib 101 of the ring 100.

With the piston 7 lowered, the blades 52 and the blades 51 (usually located outside the blades 51) are opened apart. The ring 100 may then be raised to return the rib 101 into engagement with the lower ends 6 of the blades 51, but only with these, so as to keep these apart even when the piston 7 moves upwardly to return to the initial condition illustrated in FIG. 5.

The result described above may be achieved either with a continuous upper rib 101 or with this rib constituted by separate formations (teeth, tile shaped elements) which are equiangularly spaced.

In the first case one may have the advantage that, the blades 51 being located outside the blades 52, their respective lower ends 6 are radially outside the free ends of the blades 52 whereby the upper rib 101 of the ring 100 may be inserted from beneath into the imaginary circular annulus defined by the two concentric circles on which the lower ends of the blades 52 (inner) and the free ends of the blades 51 (outer) are located.

However even when this geometric arrangement, with the free ends 6 of the blades of the two groups 51, 52 located on two circles which are concentric but of different radii, is not adopted, it is possible to make use of the angular staggering of the blades of the two arrays, by arranging the retaining elements (teeth, tile-shaped formations etc) constituting the rib 101 of the ring 100 in angular positions corresponding to the positions occupied by the free ends 6 of the blades 51 alone. In the absence of retaining elements in corresponding angular positions, the free ends 6 of the blades 52 are not held apart and reconverge resiliently towards the centre of the artichoke structure once the piston 7 returns upwardly.

Again, in the second embodiment of the invention illustrated in FIGS. 9 to 12, the basic structure already described with reference to FIGS. 1 to 4 is effectively maintained. The direction of the resilient loading of the blades 5 is however reversed in that, in the embodiment of the invention shown in FIGS. 9 to 12, the rest positions of the blades do not correspond with the condition of inward convergence relative to the artichoke structure but, on the contrary, to an open condition, that is, a condition corresponding approximately to the open condition which, in the embodiment of FIGS. 5 to 8, is attributed to the blades of the group 51 as a result of their engagement by the ring 100.

Figure 9:
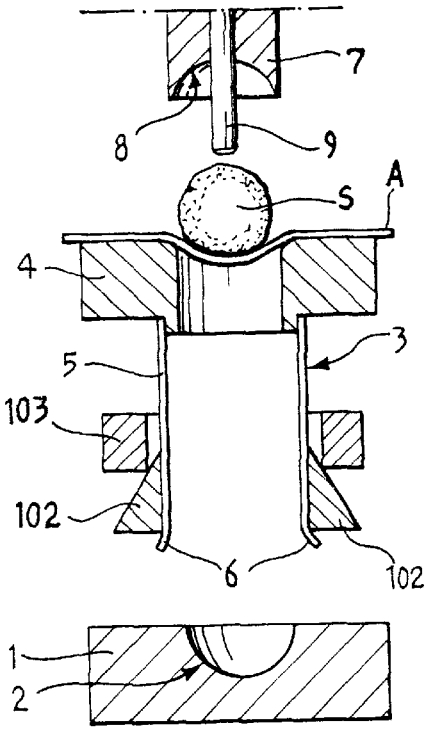
Figure 10:
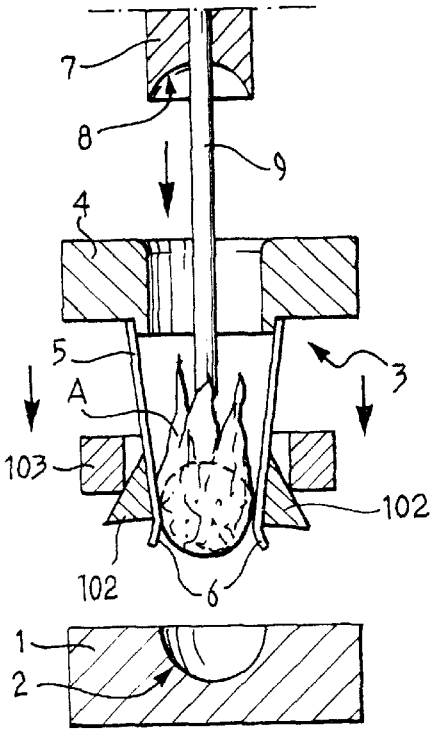
Figure 11:
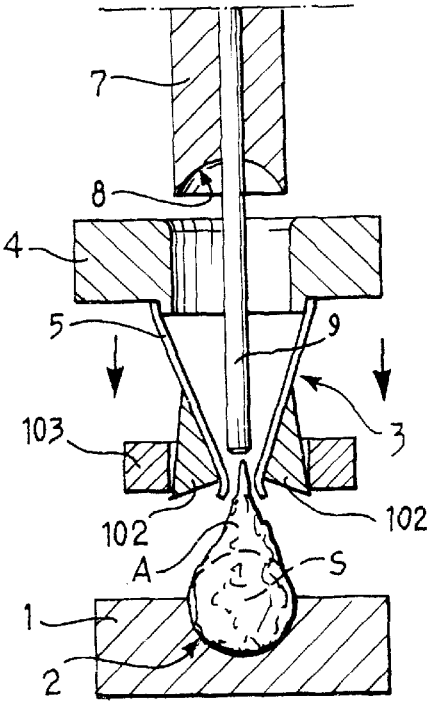
Figure 12:
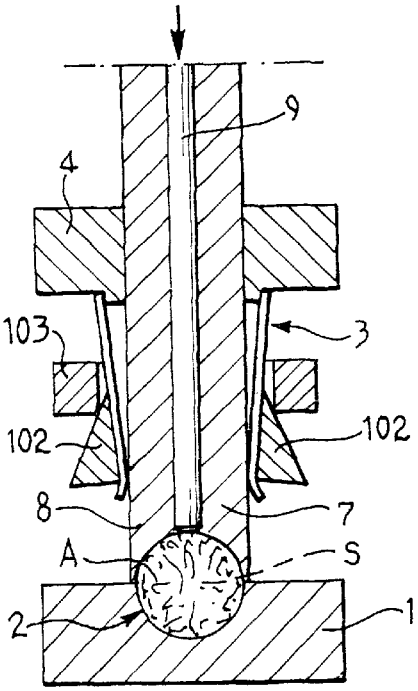

Hence, in the embodiment of FIGS. 9 to 12, the blades 5 are—all—originally in their open positions (see FIG. 9).

Reference 102 indicates ramp bodies (or more correctly cams) provided on the outer faces of all the blades 5, or some of them. The bodies 102 are intended to cooperate with a ring 103 which can also effect a selective vertical translational movement axially of the artichoke structure 4, 5. This is driven by drive means substantially like those which move the ring 100 in the embodiment of FIG. 8 and the ring 4 in the third embodiment which will be described below with reference to FIGS. 13 to 19.

The ring 103 is movable between a raised position (FIGS. 9 and 12) in which the blades 5 are located effectively in their most open positions and a lowered position in which, in moving downwardly (in particular to the positions illustrated in FIGS. 10 and 11), the ring 103 cooperates with the ramp or cam bodies 102 so as to cause the blades 5 to contract or converge inwardly of the axial cavity of the artichoke structure.

Still with reference to the ramp or cam bodies 102, as stated above, these may be arranged generally in a ring so as to surround all the blades 5 in the artichoke structure, or only some of these.

Whenever the artichoke structure defined by the blades 5 is generally rather thin, with the blades 5 greatly spaced from each other, also as regards their circumferential extent, it is essential to provide each blade 5 with a ramp or cam body 102, usually in correspondence with their lower ends 6, for cooperating with the ring 103.

When, on the other hand, the array of blades 5 is rather tight (according to the number and/or radial extent of the blades themselves) it is possible to reduce the number of ramp or cam elements 102 by making use of the fact that the contractile movement imparted positively to some of the blades is also transmitted to the other blades as a thrust and/or radial copenetration.

Figure 8:
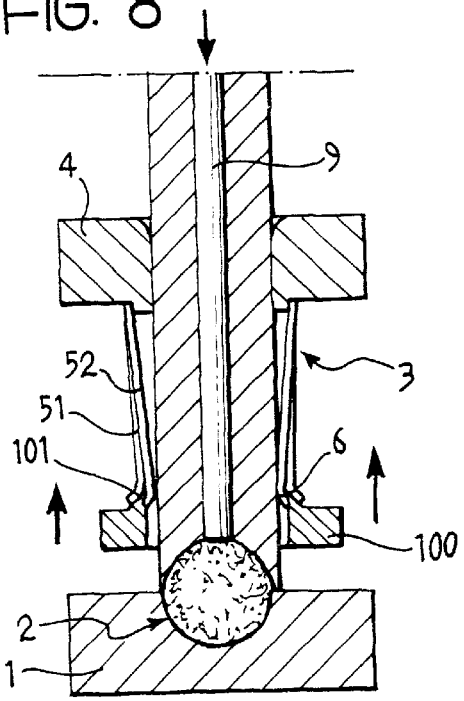

For example, supposing that a sufficiently tight array of blades is provided (in this regard one may refer to the structure illustrated in FIGS. 8 and 9 of U.S. Pat. No. 4,510,735 which has an outer array of four blades angularly spaced by 90° enclosing an inner array of four blades also angularly spaced by 90° from each other but with the inner array of blades staggered by 45° relative to the outer array or group of blades), it usually suffices to provide the ramp or cam elements 102 only on the blades in the outer array. As indicated above, this is obviously reflected in the structure of the ring 103 which may be closed or open, continuous or discontinuous.

In each case, whatever the specific solution adopted, when the article S is forced downward by the pusher element 9 into the artichoke structure so as to start the wrapping of the sheet material A around the article S, the ring 103 is lowered slightly (in principle it could even be held in its initial position if the operating conditions allow this) so as to cause the blades 5 to start converging towards the cavity of the artichoke structure.

Thus the sheet material A may be formed around the article S with extreme delicacy and, in particular, with the possibility that the convergence of the blades 5 (in practice, the diameter of the tubular orifice defined thereby) may be adjusted exactly so that it can be adapted precisely to the dimensions of the article S handled at the time and/or to the finish thereof (presence or lack of an irregular coating, the nature of the coating, nature of the product, etc).

Once the article S has descended beneath the array of blades 5, the ring 103 may be lowered further so as to bring the blades 5 themselves into their positions of maximum radial convergence so as to close the tail or bunch behind the article S.

At this point, the ring 103 may again be raised so as to allow the blades 5 to open apart again, which happens spontaneously because of the intrinsic resilience of the blades 5 themselves, so as to allow the piston 7 to descend and carry out the final step in the forming of the sheet wrapper around the article S.

It is also clear from the above that the resilient loading of the blades 5 towards their divergent positions, although preferred, is not essential in that the same mode of operation could be achieved with the blades 5 hinged at their upper ends to the ring 4, being thus free to pivot from their upper ends.

FIG. 13 illustrates the complete structure of a machine according to the invention including elements which surround and cooperate with the elements already discussed above. For this reason Darts which are identical or functionally equivalent to those already described above are again indicated by the same reference numbers in FIG. 13.

Figure 20:
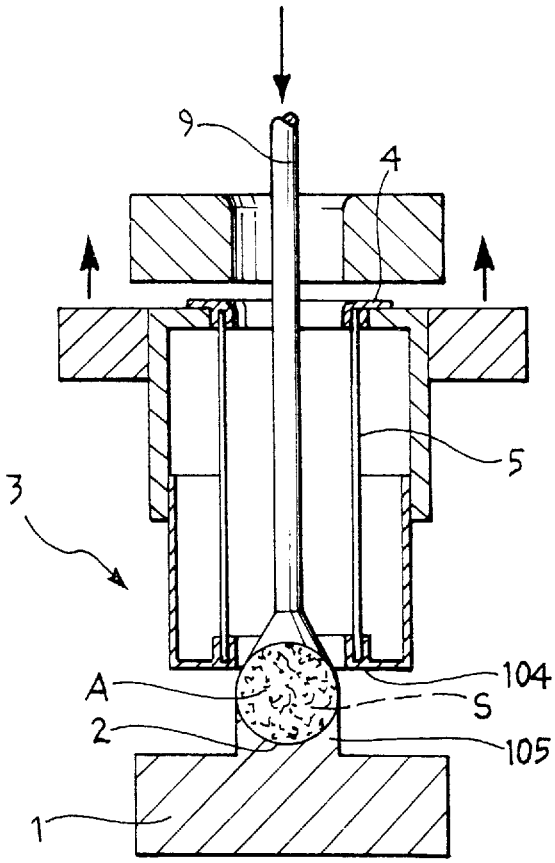

FIG. 13, as already indicated, relates to a third embodiment of the invention—currently preferred — explained in greater detail with reference to FIGS. 14 and 20. It will, however, be understood that—mutatis mutandis—the structure illustrated in FIG. 13 may also be used in the embodiments described above with reference to FIGS. 5 to 8 and 9 to 12 respectively.

With reference specifically to FIG. 13, a frame is generally indicated 10 on which are located one or more forming devices 3 having the characteristics more fully explained below. For simplicity of explanation reference is made here to a dual embodiment, with two identical twin forming devices 3.

The frame 10 preferably has a portal structure with side uprights 21 connected at their upper ends by one or more cross members 20 constituting support elements for the drive members 22 (one is usually considering fluid actuators) which drive the pusher element 9 and the piston 7, if present.

As will be more fully explained below, the embodiment illustrated in greater detail in FIGS. 14 to 20 in fact has the advantage of enabling the piston 7 to be omitted and, more particularly, its lower cavity 8 for upsetting the tail or bunched part of the wrapper around the article S.

In the lower part of the frame 21 is a fixed structure 27 constituting the base of the frame 10 on which a movable structure 23 is mounted and guided for vertical translational movement relative to the frame 21 under the action of a drive member such as one or more actuators 28.

In the embodiments of FIGS. 5 to 8 and 9 to 12 respectively, the receiving element 1 with the cavity 2 and the artichoke-like forming structure (ring 4 and blades 5 projecting downwardly therefrom) are mounted on the fixed part 27 while the movable part 23 carries the rings 100 (embodiment of FIGS. 5 to 8) and 103 (embodiment of FIGS. 9 to 12) ensuring that the vertical movement occurs in the manner described above.

In the embodiment of FIGS. 14 to 20, the forming device 3 to a certain extent loses the artichoke structure referred to and assumes a shape which can be likened approximately to that of a nozzle with a selectively variable section: one is thinking, for example, of the output nozzles of some jet motors. From another point of view one is dealing with a structure which can be likened to a type of peristaltic duct which has an intermediate portion whose section can be reduced selectively.

FIG. 14 shows structurally how, in the third embodiment of the invention, the structure of the forming device 3 includes a lower ring 104 in addition to the upper ring 4 which is generally like the rings 4 already described above. The two rings in question, which are substantially identical to each other, are intended to be mounted on the movable part 23 (ring 4) and on the fixed part 27 (ring 104) of the frame respectively. In each case, this is only one of the possible choices, the important aspect being the possibility of moving the rings 4 and 104 towards and away from each other along the direction of their common axis.

In this case the blades 5 are flexible and connected both to the ring 4 and to the ring 104.

From a constructional point of view, a solution which has been shown to be particularly useful is the formation of the forming device 3 including the blades 5 from a tubular body obtained by closing a sheet material into a tube, the material being a metal, such as steel or, in an embodiment which has been shown to be particularly advantageous, a synthetic material such as a textile-based material covered on both of its faces, or at least on one face (that intended to face into the cavity of the forming device) with a plastics material. In this latter case one is dealing with the sheet material currently used to make the belts of conveyors in packaging plants usable for food products. The wall of the tubular element is then cut along lines 106 extending approximately along the generatrices of the cylindrical body.

Following a slight twisting of the cut-walled cylindrical body thus obtained, the various wall portions separated by the slits or cuts 106, intended to form the blades 5, tend to overlap at their edges. This overlapping movement may be adjusted, by positive intervention, possibly manually, so as to make the blades overlap like tiles and thus, supposing one views the blades 5 in question by following an imaginary orbital path around the body of the forming device 3, so that the "downstream" edges (in the direction of this imaginary orbital movement) of all of the blades 5 are arranged so as to overlap the respective "upstream" edges of the adjacent blades, or vice a versa.

This tiled arrangement is considered largely preferable even though it is not strictly essential for the purposes of the invention.

In each case, starting from the extended position of the forming device 3 shown in FIG. 14, the approach of the rings 4 and 104 causes the central portions of the blades 5 between the rings 4 and 104 to curve, bending inwardly of the forming device 3 into a configuration generally like an hourglass (as seen in particular in FIG. 15). Thus the section of the axial orifice defined by all the blades 5 assumes maximum values adjacent the rings 4 and gradually reduces (along the said hourglass shape) to a minimum value, virtually nil, at the middle. Naturally the degree to which this section is reduced at the middle can be regulated since it can be determined selectively by regulation of the travel of the rings 4 and 104 towards each other. For this purpose, it should also be noted that what matters is the relative movement. While in the solution illustrated here it is the ring 4 that moves, it would be possible to arrange for the ring 4 to be kept fixed while the ring 104 moves or, alternatively, for both of the two rings to move towards and away from each other. Naturally, as the rings 4 and 104 are moved away from each other again so as to expand the blades 5, the forming device 3 returns to the position illustrated in FIG. 14 in which the axial orifice defined by the blades 5 has a practically constant section.

Experiments carried out by the Applicant have shown that the hourglass shape assumed by the blades 5 in the axially compressed condition of the forming device 3 is such that, in these conditions, the axial cavity of the forming device 3 itself, as seen from the axial orifice of the ring 4 and, particularly, from the axial orifice of the ring 104, has an approximately hemispherical shape: in effect the generally hourglass shape may be seen as the theoretical juxtaposition of two hemispheres connected together at their respective poles.

The sequence shown in FIGS. 17 to 20 reproduces, in essence, the same sequence as that described originally with reference to FIGS. 1 to 4 and repeated in the sequences of FIGS. 5 to 8 and 9 to 12. This sequence envisages that the forming device 3 is kept in its extended condition when the article S is located on the mouth of the ring 4 with the interposition of the sheet material A (FIG. 16) and when, as a result of the lowering of the pusher element 9, the article S is advanced (lowered in this specific case) through the axial cavity of the forming device 3 so as to start the wrapping of the sheet material A around the article S.

For reasons which will be clarified below, in the embodiment of FIGS. 16 to 19, the cavity 2 in the receiving element 1 is in practice formed in a raised portion 105 which is inserted into the axial cavity of the forming device 3, being in fact surrounded by the lower ring 104 of the forming device 3 itself, when the forming device 3 is moved downwardly to abut the element 1 and the fixed part 27 of the frame 10.

Figure 17:
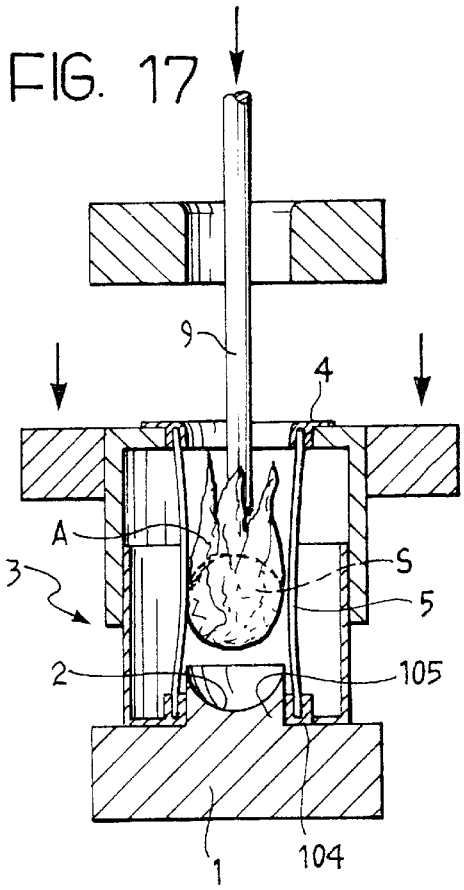
Figure 18:
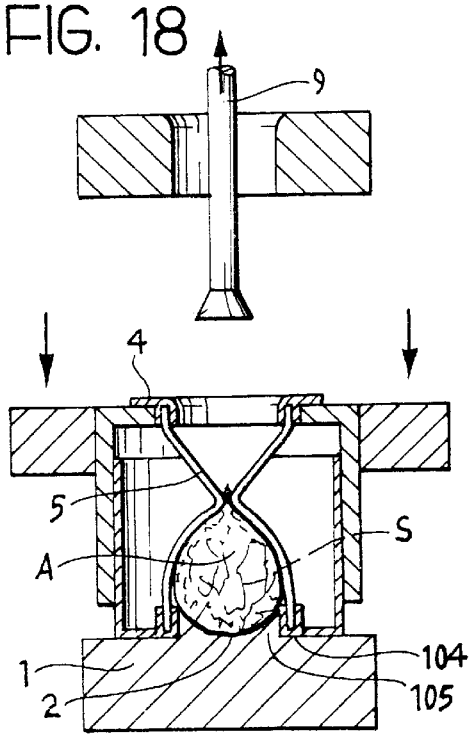
Figure 19:
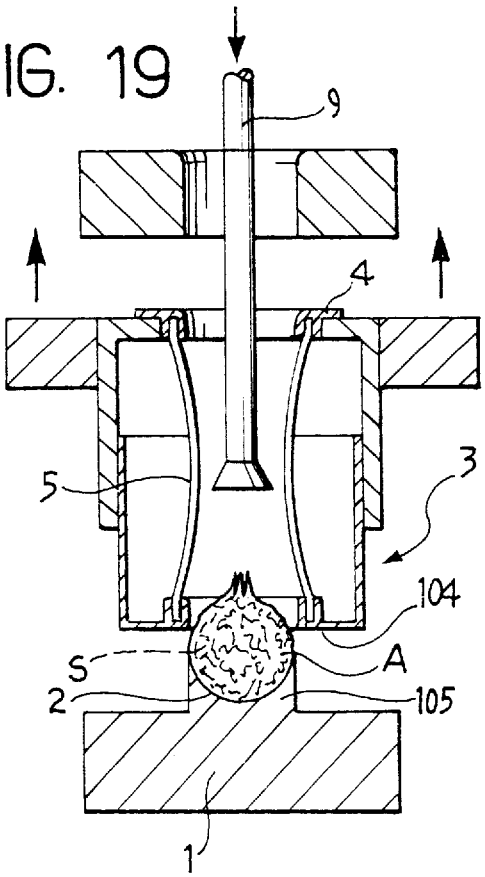

The third embodiment of the invention described here differs from the other embodiments of the invention (see in particular FIGS. 6 and 7 and FIGS. 10 and 11) in that the pusher element 9 is driven, (in known manner) by means of the actuator 22, so that it pushes the article S, with the wrapper A wrapped around it, until it is deposited in the cavity 2 of the receiving element 1. This is until the situation illustrated in FIG. 17 is reached.

At this point, the pusher element 9 is returned upwardly so as to disengage the axial cavity in the forming device 3 while the movable part 23 is lowered by means of the actuators 28. The ring 4 starts to descend towards the ring 104 causing the relative axial approach which causes the curving of the blades 5 (FIG. 17).

The approach movement is continued until the blades 5 are given the hourglass shape mentioned above.

As a result of the deformation of the blades 5, the lower part of the axial cavity in the forming device, as already indicated, assumes a generally hemispherical configuration, in fact complementary to the shape of the upper part of the article S and a mirror image of the shape of the cavity 2 in the receiving die 1.

Consequently, the deformation of the blades 5 causes the closure of the sheet wrapper A behind the article S, or over that region in which, in the other embodiments described, the tail or bunched portion is formed and, the at least partial pressing of this part of the sheet material against the article S.

The pusher element 9 may then be used to complete and/or achieve the pressing action. For this purpose, after the ring 4 has been raised so that the blades (FIG. 19) expand again, the actuator 22 may again be activated to force the pusher element 9 downward (the lower end of which usually has a slightly enlarged foot) until it acts on the vertex of the article S, pressing the crest portion of the wrapper to its final position against the article S itself.

Naturally, the principle of the invention remaining the same, the constructional details and forms of embodiment may be varied widely with respect to those described and illustrated. This is true in particular with regard to the possibility of transferring specific characteristics illustrated with reference to one of the embodiments freely to any of the other embodiments described above: it is completely clear that each and all of the characteristics is freely transferable from one embodiment to another. Again the formation of a tubular body having a cross-section which can contract does not necessarily imply the use of a bladed structure such as that described above even though this embodiment is currently preferred. A generally similar result could be achieved, for example, with the aid of a continuous or substantially continuous tubular body of a deformable material, an intermediate part of which could be squashed by means of presser elements or even as a result of the twisting of the body about its axis.

What is claimed is:

1. An apparatus for wrapping an article with sheet material by means of a wrapping operation, said apparatus comprising:

a forming device having an annular mouth and constriction members defining a cavity through which the article advances;

pusher means which push the article through said cavity so as to cause partial, frontal wrapping of a leading portion of the article with a sheet of the sheet material that has been interposed between the article and said mouth at the beginning of the wrapping operation; and contraction means which cause contraction of said cavity by constriction inward of said constriction members whereby a portion of the sheet of sheet material trailing the article through the cavity is pinched together behind the article to form a tail of sheet material;

wherein said contraction means are configured such that said forming device selectively has 1) a first operating configuration during advance of the article through said cavity, at least a subset of said constriction members not constricting inward when said forming device is in said first operating configuration; and 2) a second operating configuration after the article has advanced through said cavity, said subset of said constriction members constricting inward to cause contraction of said cavity when said forming device is in said second operating configuration so as to pinch together the portion of sheet material trailing the article through the cavity.

2. The apparatus of claim 1, wherein said constriction members comprise first resilient means and second resilient means projecting from said mouth, said first and second resilient means being biased toward positions corresponding to a minimum cross-section of said cavity, said contraction means comprising switch means which, when said forming device is in said first operating condition, are engaged with said first resilient means such that said cavity is defined solely by said second resilient means and which, when said forming device is in said second operating condition, are disengaged from said first resilient means such that said cavity is defined jointly by said first and said second resilient means.

3. The apparatus of claim 2, wherein said first and second resilient means are in the form of blades.

4. The apparatus of claim 3, wherein said blades are cantilevered from said mouth and have free ends opposite said mouth, said first resilient means constituting a first group of said blades and said contraction means comprising engagement elements which cooperate with the free ends of said first group of blades.

5. The apparatus of claim 4, wherein said contraction means comprise an annular element which is movable toward and away from the free ends of the blades of at least said first group, said annular element having an engagement formation which engages the free ends of the blades of said first group.

6. The apparatus of claim 5, wherein the free ends of the blades constituting said first and second resilient means are located along respective concentric, radially spaced paths, said engagement formation being insertable between said concentric, radially spaced paths.

7. The apparatus of claim 4, wherein the blades constituting said first resilient means and the blades constituting said second resilient means are angularly staggered relative to each other, the engagement elements having retaining parts that are angularly located so as to permit selective engagement with the free ends of the blades constituting said first resilient means.

8. The apparatus of claim 1, wherein said constriction members comprise wall elements which define said cavity, at least some of said wall elements carrying control means which control positioning of said wall elements such that 1) when said forming device is in said first operating condition, said wall elements are generally opened apart, and 2) when said forming device is in said second operating condition, said wall elements converge toward the center of said cavity to cause constriction of said cavity.

9. The apparatus of claim 8, wherein said wall elements comprise resilient blades which are resiliently biased toward being generally opened apart, and wherein said control means push said wall elements toward each other, against resilient biasing forces of said blades, to cause contraction of said cavity.

10. The apparatus of claim 8, wherein said control means comprise ramp or cam surfaces.

11. The apparatus of claim 10, wherein said control means further comprise a generally annular element that is axially movable relative to the wall elements, said generally annular element cooperating with said ramp or cam surfaces to cause constriction of said cavity.

12. The apparatus of claim 10, wherein said control means comprise a plurality of said ramp or cam surfaces, each associated with a respective one of said wall elements, and a single, substantially annular body which cooperates simultaneously with all of said ramp or cam surfaces to cause constriction of said cavity.

13. The apparatus of claim 1, said apparatus further comprising:

a receiving cavity positioned to receive the article after the article has advanced completely through said cavity, and a piston presser member having a cavity in an end thereof, said piston presser member configured to advance toward said receiving cavity so as to press the tail of sheet material against the article.

14. The apparatus of claim 13, wherein said pusher means includes a shaft which advances selectively into said cavity and wherein said piston presser member is disposed coaxially with said pusher means.

15. The apparatus of claim 1, wherein said forming device comprises a generally tubular body divided into a plurality of flexible blades which constitute said constriction members, said blades being connected at opposite ends to two substantially annular end bodies, wherein said contraction means cause said end bodies to move toward and away from each other between first and second relative positions corresponding to said first and second operating conditions of said forming device, respectively, said blades being generally expanded or unbent when said end bodies are in said first relative position, said blades constricting inward so as to give said tubular body a generally hourglass configuration when said end bodies are in said second relative position.

16. The apparatus of claim 15, wherein said blades are arranged in an overlapping, tiled arrangement.

17. The apparatus of claim 15, wherein said blades comprise metal.

18. The apparatus of claim 15, wherein said blades comprise textile material coated with plastic material at least on surfaces which face in toward said cavity.

19. The apparatus of claim 15, further comprising a receiving element extending slightly into said cavity at an end portion thereof, said receiving element having a receiving cavity at an end thereof to receive the article once the article has advanced through said cavity and has been partially, frontally wrapped with the sheet of sheet material, said apparatus being configured such that when said forming device is in said second operating condition and said tubular body has said generally hourglass configuration, portions of said blades which face in toward said cavity converge in a generally hemispherical formation so as to wrap the sheet of sheet material around a trailing portion of the article and so as to press the sheet of sheet material against the trailing portion of the article.

20. The apparatus of claim 15, further comprising a support frame having a fixed part and a movable part that is movable relative to said fixed part, wherein one of said end bodies is connected to said fixed part and the other of said end bodies is connected to said movable part.

* * * * *